PLATE MOLD FOR THE CONTINUOUS CASTING OF METALS

FIELD OF THE INVENTION

This invention relates to the molds for the continuous casting of metals, and more particularly to the so called plate molds for the continuous casting of metals, that is molds formed by a number of copper plates assembled together so as to form a continuous casting mold. The said mold plates are normally provided with passages for the circulation of a refrigerating fluid, such as water.

BRIEF DESCRIPTION OF THE PRIOR ART

According to one prior method, the said passages were formed by boring a number of holes through the thickness of said mold plates. This method is difficult to be performed, time consuming and expensive.

According to the german patent publication No. 1964048 to Adolf Kipp, filed Dec. 22, 1969 and published Dec. 1st, 1977, a method is described according to which the said passages are formed in the back side of said mold plates in form of grooves, which are thereafter closed by means of thin metal sheets glued to the back side of the mold plates, and firmly maintained into position by steel plates bolted to the mold plates.

Also this method is costly, time consuming and it does not solve the problems of an efficient heat exchange between the mold plate and the refrigerating fluid.

SUMMARY OF THE INVENTION

It is therefore the main object of the present invention to provide a mold plate of the kind referred to, in which the above problems are solved in a simple yet reliable manner.

According to one preferred embodiment of the invention, the mold plate for plate molds for the continuous casting of metals comprises a copper plate provided on one side with a number of grooves; a bar or strip inserted in each of said grooves, said bar being so shaped as to define between its outer periphery and the inner surface of the groove a flow jacket of reduced flow section with respect to the section of said groove, for the passage of the refrigerating water, and a metallic list encased in said groove, above said bar, so as to firmly maintain said bar in said groove.

According to one further feature of the invention, said groove has a substantially triangular cross section, with rounded apex, and the said bar has a corresponding cross sectional shape, and is made from plastics material, such as polytetraflouroethylene (i.e., Teflon, manufactured by DuPont Corporation, Wilmington, Delaware), siliconic resins, and the like.

BRIEF DESCRIPTION OF THE DRAWINGS

Further objects and advantages of the invention will be evident from the following description of a preferred embodiment of the invention, made with reference to the enclosed drawing, in which.

DESCRIPTION OF THE PREFERRED EMBODIMENT OF THE INVENTION

Figures 1, 2, 3:
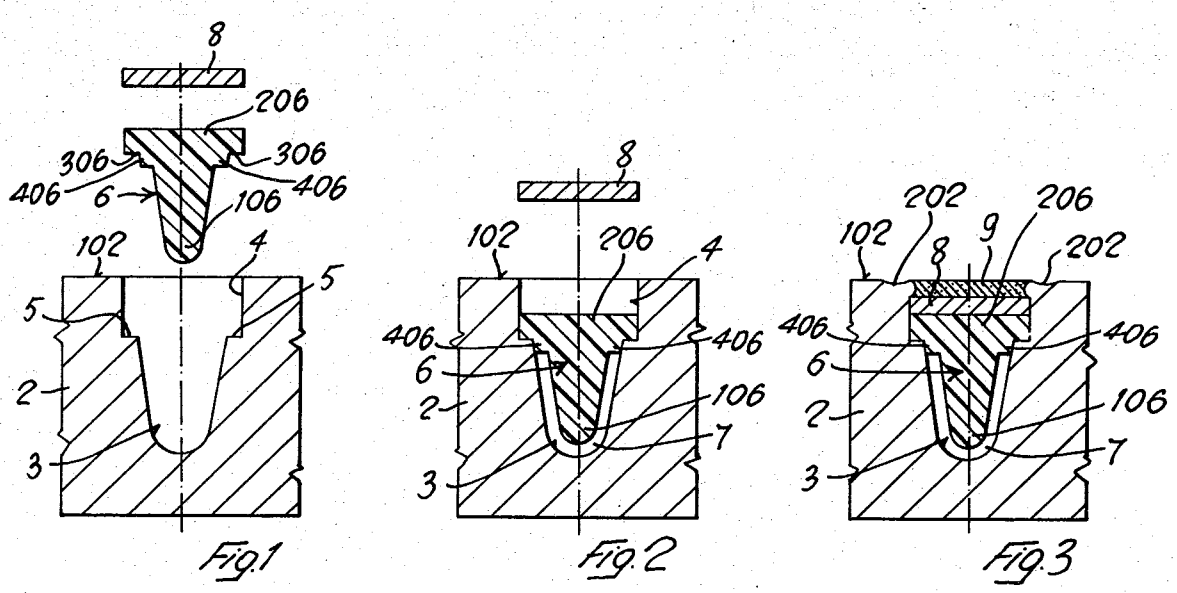
FIG. 1 is a partial, cross sectional, exploded view of a mold plate with its closure bar and closure list.
FIG. 2 is a view similar to FIG. 1, with the closure bar inserted in the groove of the mold plate.
FIG. 3 is a view similar to FIGS. 1 and 2, with both the closure bar and closure list mounted in place in the groove of the mold plate, and held in place by upsetting the free edge of the groove over the edges of the closure list.

With reference to the drawing, copper mold plate 2 is shown, and is of the type used for assembling plate molds for the continuous casting of metals.

As shown in FIG. 1, a representative portion of plate 2 is provided on an outer surface 102 thereof with a deep groove. Surface 102 is opposite to that surface exposed to the metal being cast with the mold.

In the embodiment shown, each of the aforesaid grooves includes a substantially triangular cross sectional portion designated with reference numeral 3, with a rounded apex. Each groove is also provided with a rectangular cross sectional shaped base 4 having a stepped portion 5 located between base 4 and portion 3.

The closure bar 6 comprises a base portion 206, of rectangular cross section, having a width corresponding to the width of base 4 of the groove; the height of portion 206 is less than the height of base 4. The portion 206 is connected, through a step 306, to the portion 406 of reduced height, shaped so as to mate the root section of portion 3 of the groove formed in plate 2. From the central part of portion 406 of the bar 6 a rib 106 projects in the direction of portion 3 of the groove of plate 2. The said rib 6 has a cross sectional shape corresponding substantially to the shape of the portion 3 of the groove, with the exception that it is of less width and height, so as to define, whenever inserted in said groove, between the inner walls of the groove 3 and its outer walls a gap or jacket 7 for the flow of the refrigerating water, as best shown in FIGS. 2 and 3. The bar 6 is preferably made from plastics material, as for instance Teflon, or the like.

The bar 6 is introduced into the groove 3-4 with the rib 106 directed toward the apex of portion 3 of the groove, up to abutment of the stepped portion 306 against the stepped portion 5 of the groove. Thereafter, a metallic closure list 8, of rectangular cross sectional shape, having a width closely corresponding to the width of the base 4 of the groove, is inserted in the base portion 4 of the groove. The said list 8 has a height such as to be completely encased in the said base portion 4. In order to firmly maintain in place the list 8 and the bar 6, the free edges of the groove of plate 2 are upset over the edges of the closure list 8, as shown by reference 202, and the space above the list 8 is filled by casting in it a low melting point metal alloy, and for instance a tin alloy 9.

It will be evident that, according to the invention, a high heat transmission coefficient is obtained between the water flowing in jacket 7 and the copper plate 2, whilst the flow resistance of the water is reduced, thus enhancing also the flow speed of the refrigerating water. In this manner the best heat exchange is attained.

Having thus described my invention what I claim is:

1. A mold plate of a plate mold used in the continuous casting of metal, comprising a heat conductive plate having an outer surface and an opposite surface substantially exposed to the casting metal, said plate including a groove defined in the outer surface thereof, the groove including a base portion; a thermoresistant plastic insert bar disposed in said groove and being shaped and dimensioned to define a flow passage between the insert bar and an inner surface of the groove for circulating a cooling medium therethrough, said flow pas- 8
206
306
406
106
4
5
102
6
306
406
5
2
3

8
206
4
406
106
7
102
406
6
2
3

206
202
406
106
7
9
202
8
102
406
6
2
3

PLATE MOLD FOR THE CONTINUOUS CASTING OF METALS

FIELD OF THE INVENTION

This invention relates to the molds for the continuous casting of metals, and more particularly to the so called plate molds for the continuous casting of metals, that is molds formed by a number of copper plates assembled together so as to form a continuous casting mold. The said mold plates are normally provided with passages for the circulation of a refrigerating fluid, such as water.

BRIEF DESCRIPTION OF THE PRIOR ART

According to one prior method, the said passages were formed by boring a number of holes through the thickness of said mold plates. This method is difficult to be performed, time consuming and expensive.

According to the german patent publication No. 1964048 to Adolf Kipp, filed Dec. 22, 1969 and published Dec. 1st, 1977, a method is described according to which the said passages are formed in the back side of said mold plates in form of grooves, which are thereafter closed by means of thin metal sheets glued to the back side of the mold plates, and firmly maintained into position by steel plates bolted to the mold plates.

Also this method is costly, time consuming and it does not solve the problems of an efficient heat exchange between the mold plate and the refrigerating fluid.

SUMMARY OF THE INVENTION

It is therefore the main object of the present invention to provide a mold plate of the kind referred to, in which the above problems are solved in a simple yet reliable manner.

According to one preferred embodiment of the invention, the mold plate for plate molds for the continuous casting of metals comprises a copper plate provided on one side with a number of grooves; a bar or strip inserted in each of said grooves, said bar being so shaped as to define between its outer periphery and the inner surface of the groove a flow jacket of reduced flow section with respect to the section of said groove, for the passage of the refrigerating water, and a metallic list encased in said groove, above said bar, so as to firmly maintain said bar in said groove.

According to one further feature of the invention, said groove has a substantially triangular cross section, with rounded apex, and the said bar has a corresponding cross sectional shape, and is made from plastics material, such as polytetraflouroethylene (i.e., Teflon, manufactured by DuPont Corporation, Wilmington, Delaware), siliconic resins, and the like.

BRIEF DESCRIPTION OF THE DRAWINGS

Further objects and advantages of the invention will be evident from the following description of a preferred embodiment of the invention, made with reference to the enclosed drawing, in which:

FIG. 1 is a partial, cross sectional, exploded view of a mold plate with its closure bar and closure list.

FIG. 2 is a view similar to FIG. 1, with the closure bar inserted in the groove of the mold plate, and FIG. 3 is a view similar to FIGS. 1 and 2, with both the closure bar and closure list mounted in place in the groove of the mold plate, and held in place by upsetting the free edge of the groove over the edges of the closure list.

DESCRIPTION OF THE PREFERRED EMBODIMENT OF THE INVENTION

With reference to the drawing, copper mold plate 2 is shown, and is of the type used for assembling plate molds for the continuous casting of metals.

As shown in FIG. 1, a representative portion of plate 2 is provided on an outer surface 102 thereof with a deep groove. Surface 102 is opposite to that surface exposed to the metal being cast with the mold.

In the embodiment shown, each of the aforesaid grooves includes a substantially triangular cross sectional portion designated with reference numeral 3, with a rounded apex. Each groove is also provided with a rectangular cross sectional shaped base 4 having a stepped portion 5 located between base 4 and portion 3.

The closure bar 6 comprises a base portion 206, of rectangular cross section, having a width corresponding to the width of base 4 of the groove; the height of portion 206 is less than the height of base 4. The portion 206 is connected, through a step 306, to the portion 406 of reduced height, shaped so as to mate the root section of portion 3 of the groove formed in plate 2. From the central part of portion 406 of the bar 6 a rib 106 projects in the direction of portion 3 of the groove of plate 2. The said rib 6 has a cross sectional shape corresponding substantially to the shape of the portion 3 of the groove, with the exception that it is of less width and height, so as to define, whenever inserted in said groove, between the inner walls of the groove 3 and its outer walls a gap or jacket 7 for the flow of the refrigerating water, as best shown in FIGS. 2 and 3. The bar 6 is preferably made from plastics material, as for instance Teflon, or the like.

The bar 6 is introduced into the groove 3-4 with the rib 106 directed toward the apex of portion 3 of the groove, up to abutment of the stepped portion 306 against the stepped portion 5 of the groove. Thereafter, a metallic closure list 8, of rectangular cross sectional shape, having a width closely corresponding to the width of the base 4 of the groove, is inserted in the base portion 4 of the groove. The said list 8 has a height such as to be completely encased in the said base portion 4. In order to firmly maintain in place the list 8 and the bar 6, the free edges of the groove of plate 2 are upset over the edges of the closure list 8, as shown by reference 202, and the space above the list 8 is filled by casting in it a low melting point metal alloy, and for instance a tin alloy 9.

It will be evident that, according to the invention, a high heat transmission coefficient is obtained between the water flowing in jacket 7 and the copper plate 2, whilst the flow resistance of the water is reduced, thus enhancing also the flow speed of the refrigerating water. In this manner the best heat exchange is attained.

Having thus described my invention what I claim is:

1. A mold plate of a plate mold used in the continuous casting of metal, comprising a heat conductive plate having an outer surface and an opposite surface substantially exposed to the casting metal, said plate including a groove defined in the outer surface thereof, the groove including a base portion; a thermoresistant plastic insert bar disposed in said groove and being shaped and dimensioned to define a flow passage between the insert bar and an inner surface of the groove for circulating a cooling medium therethrough, said flow passage being of reduced flow section relative to a corresponding section of said groove; closure means encased within the base portion of said groove the base portion being located outwardly from and adjacent in outer surface of said insert bar, said closure means including a closure plate being encased in the base of said groove so as to be recessed within the groove so as to firmly secure said insert bar in said groove; and means for sealing and securing said closure plate to said mold plate, said sealing means including a low melting point alloy filled in a space defined by the recessed area formed by an outer surface of the closure plate and the base portion of the groove.

2. A mold plate according to claim 1, wherein said groove includes a substantially triangular cross sectional shape having a rounded apex extending towards the opposite surface of the mold plate, said insert bar having a rib of cross sectional shape corresponding to the shape of said groove and of reduced width and height, and extending into said groove to define said flow passage.

3. A mold plate according to claim 1, wherein said closure plate is formed of steel.

4. A mold plate according to claim 1, wherein said thermoresistant plastic is polytetraflouroethylene.

5. A mold plate according to claim 1, wherein said sealing means includes deformed edges of the base of the groove overlapping edges of the closure plate.

* * * * *